US010738794B2

(12) United States Patent
Rao et al.

(10) Patent No.: US 10,738,794 B2
(45) Date of Patent: Aug. 11, 2020

(54) ANTI-SWIRL RIB SYSTEM FOR A PUMP

(71) Applicant: SCHLUMBERGER TECHNOLOGY CORPORATION, Sugar Land, TX (US)

(72) Inventors: Abhisek Robert Rao, Cuttack (IN); Jerome Ang Sze Jiunn, Toa Payoh Central (SG); David Milton Eslinger, Collinsville, OK (US); Tony R. Morrison, Caney, KS (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 463 days.

(21) Appl. No.: 15/502,242

(22) PCT Filed: Jul. 31, 2015

(86) PCT No.: PCT/US2015/043073
§ 371 (c)(1),
(2) Date: Feb. 7, 2017

(87) PCT Pub. No.: WO2016/022413
PCT Pub. Date: Feb. 11, 2016

(65) Prior Publication Data

US 2017/0248159 A1 Aug. 31, 2017

Related U.S. Application Data

(60) Provisional application No. 62/034,912, filed on Aug. 8, 2014.

(51) Int. Cl.
*F04D 29/44* (2006.01)
*F04D 13/10* (2006.01)
(Continued)

(52) U.S. Cl.
CPC ..... *F04D 29/448* (2013.01); *F04D 1/063* (2013.01); *F04D 13/10* (2013.01); *F04D 29/445* (2013.01); *F04D 29/669* (2013.01)

(58) Field of Classification Search
CPC ..... F04D 13/10; F04D 1/063
See application file for complete search history.

(56) References Cited

U.S. PATENT DOCUMENTS 1,387,660 A * 8/1921 Ostenberg ..... F04D 1/063 415/199.3
2,954,739 A * 10/1960 Lung ..... F04D 13/10 415/140

(Continued)

FOREIGN PATENT DOCUMENTS

JP 10-089281 A 4/1998
JP 200500294 A 1/2005

*Primary Examiner* — Christopher S Bobish

(57) ABSTRACT

A technique employs a system and methodology for improving sand control in pumps. The technique may be used in centrifugal pumps by providing uniquely constructed rib feature to facilitate sand control and thus reduction of erosion due to sand in the pumped fluid. The improved sand control is useful in centrifugal pumps employed in a variety of oilfield applications, such as in electric submersible pumping systems positioned downhole in a wellbore to pump oil or other fluids. The rib feature may be used in combination with a shield and arranged along diffuser bowl walls or other diffuser walls within sequential pump stages.

19 Claims, 8 Drawing Sheets

(51) Int. Cl.
*F04D 1/06* (2006.01)
*F04D 29/66* (2006.01)

(56) References Cited

U.S. PATENT DOCUMENTS

| | | | | | |
|---|---|---|---|---|---|
| 3,116,696 | A * | 1/1964 | Deters | F04D 13/10 | 415/140 |
| 3,154,019 | A * | 10/1964 | Hoyt | F04D 13/10 | 415/112 |
| 3,265,001 | A * | 8/1966 | Deters | F04D 13/10 | 415/141 |
| 3,612,716 | A * | 10/1971 | Deters | F04D 13/10 | 415/140 |
| 3,730,641 | A * | 5/1973 | Gordon | F04D 1/06 | 415/199.3 |
| 7,841,826 | B1 * | 11/2010 | Phillips | E21B 43/128 | 415/121.1 |
| 8,556,580 | B2 * | 10/2013 | Stair | F04D 7/045 | 415/199.2 |
| 9,039,356 | B1 * | 5/2015 | Nowitzki | F04D 29/54 | 415/169.1 |
| 9,200,642 | B2 * | 12/2015 | Nowitzki | F04D 29/54 | |
| 10,233,937 | B1 * | 3/2019 | Volk | F04D 29/086 | |
| 2005/0074330 | A1 | 4/2005 | Watson et al. | | |
| 2009/0047119 | A1 * | 2/2009 | Bookout | F04D 1/063 | 415/71 |

* cited by examiner

ANTI-SWIRL RIB SYSTEM FOR A PUMP

CROSS-REFERENCE TO RELATED APPLICATIONS

The present document is based on and claims priority to U.S. Provisional Application Serial No.: 62/034,912 filed Aug. 8, 2014, which is incorporated herein by reference in its entirety.

BACKGROUND

Electric Submersible Pump (ESP) systems are used in a variety of well applications. ESP systems may comprise centrifugal pumps having a plurality of stages with each stage employing a diffuser and an impeller. In oil wells producing substantial amounts of sand, the lifetime of the centrifugal pump may be shortened due to excessive wear. The sand tends to wear on the pumping system components and increases clearances in the case of radial wear. This type of wear can lead to a decrease in the head flow and an increased horsepower demand, thus affecting pump performance. The abrasive sand also can cause holes to develop in diffuser walls and can lead to erosion of pump passages.

Erosive wear often occurs at points where flow discontinuities exist and also in void areas of the diffuser and impeller where sand can get entrapped and circulated. During operation of the ESP system, sand can get trapped between the impeller lower shroud and the bottom surface of the diffuser cup. In spite of the large clearance in this area, the spinning action of the impeller causes a wave action at the point of unison of the bottom inside surface of the diffuser and the inside side wall. Due to the tangential velocity of the cavity fluid discharged by the impeller, the swirling of the sand at the point of unison between the bottom inside surface and the inside side wall of the diffuser causes an erosive action at this junction and eventually may cut through the diffuser wall. Severe erosion of the upper shroud in radial flow impellers can lead to separation of the upper shroud from the impeller hub. Sand particles also can settle between the outer rim of the impeller bottom shroud and the diffuser inner wall and become trapped, thus moving around until they are reduced in size or cut through the wall of the diffuser. However, attempts to reduce the velocity of the cavity fluid tend to create friction or drag, and the degree of such drag increases exponentially with radius, e.g. the radius of the impeller.

SUMMARY

In general, a system and methodology are provided for improving sand control in pumps. The technique may be used in centrifugal pumps by employing a uniquely constructed rib feature to facilitate sand control and thus reduction of erosion due to sand in the pumped fluid. The improved sand control is useful in centrifugal pumps employed in a variety of oilfield applications, such as in electric submersible pumping systems positioned downhole in wellbores to pump oil or other fluids. In at least some embodiments, the potential for erosion of the diffuser is reduced by reducing the swirl of fluid in regions susceptible to erosion while also minimizing friction or drag effects on a corresponding rotating impeller.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for improving sand control in pumps. The technique may be used in centrifugal pumps by employing a uniquely constructed rib feature to facilitate sand control and thus to reduce erosion from sand in the pumped fluid. The rib feature may be deployed in a variety of diffusers used in centrifugal pumps, such as the centrifugal pumps employed in electric submersible pumping systems operated downhole in sandy environmental conditions.

By way of example, the rib feature may comprise anti-swirl ribs located in diffusers used in stages of centrifugal pumps. The anti-swirl ribs are constructed to reduce erosive wear at, for example, a circumference of the diffuser. Some configurations of the ribs facilitate movement of the sand from the circumference towards a center to reduce the erosive effect at the periphery of the diffuser. A variety of streamlined rib configurations are described herein for use in a variety of diffusers to reduce the detrimental effects of sand in the pumped fluid.

In some applications, various configurations of the sand control rib feature may be located along internal surfaces of the diffuser bowl portion of at least some of the diffusers. The diffuser bowl comprises a portion of the diffuser directly upstream of the subsequent, adjacent impeller. The pumped fluid is directed through portions of the diffuser and into the diffuser bowl where it is then received by the next sequential impeller. The spinning action of the impeller can cause sand particles in the fluid to erode radially outer portions of the diffuser bowl in conventional pumps. Embodiments of the rib feature described herein reduce these erosive effects. In some embodiments, the potential for erosion of the diffuser is reduced by reducing the tangential velocity, e.g. swirl, of fluid in regions susceptible to erosion while also minimizing friction or drag effects on a corresponding rotating impeller. For example, shielded anti-swirl ribs may be positioned in the diffuser to reduce tangential velocity, e.g. swirl, in a region susceptible to erosion while allowing substantially higher tangential velocity proximate the corresponding impeller structure, e.g. impeller shroud, to minimize friction or drag effects on the impeller.

Figure 1:
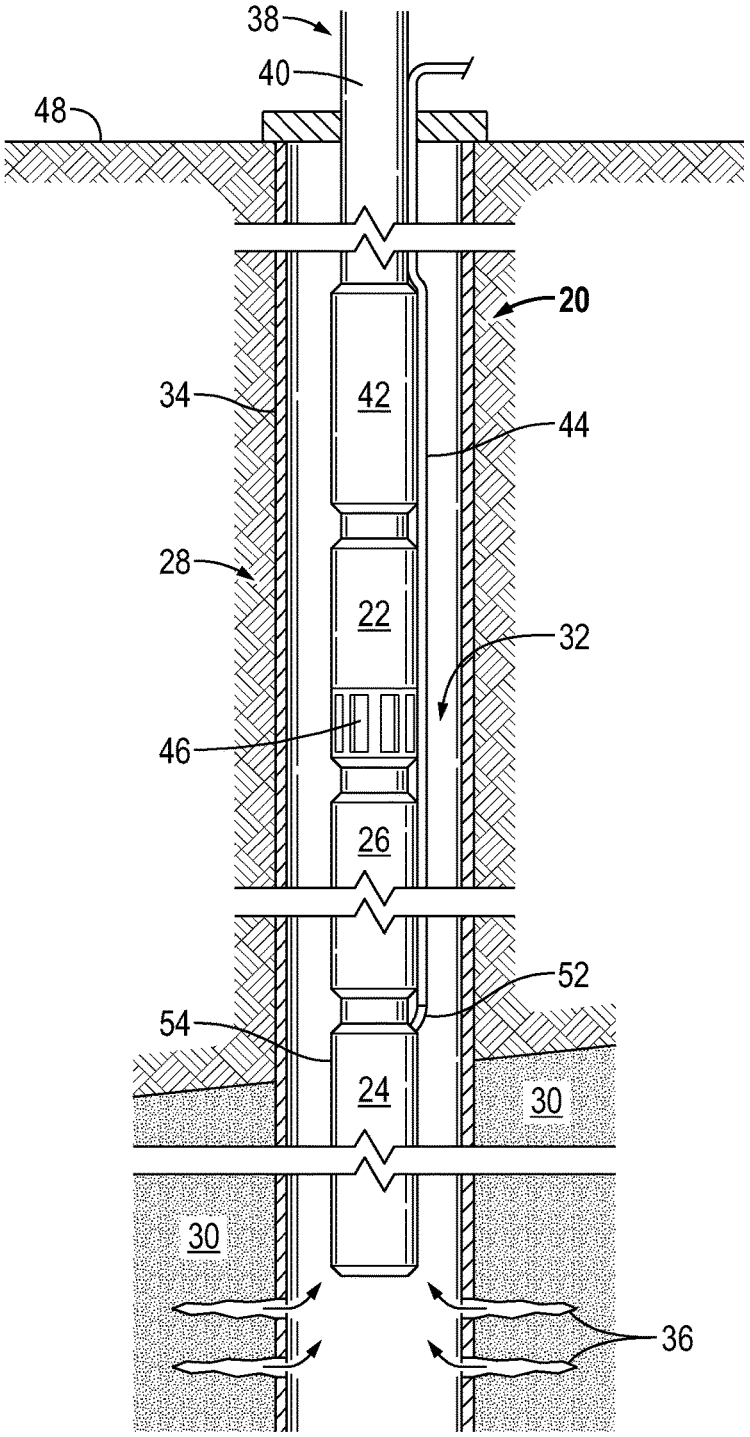
FIG. 1 is an illustration of an example of an electric submersible pumping system having a centrifugal pump utilizing a sand control rib feature, according to an embodiment of the disclosure.

Referring generally to FIG. 1, an embodiment of a submersible pumping system 20, such as an electric submersible pumping system, is illustrated. Submersible pumping system 20 may comprise a variety of components depending on the particular application or environment in which it is used. Examples of components utilized in pumping system 20 comprise at least one submersible pump 22, at least one submersible motor 24, and at least one motor protector 26 coupled together to form the submersible pumping system 20.

In the example illustrated, submersible pumping system 20 is designed for deployment in a well 28 within a geological formation 30 containing desirable production fluids, such as petroleum. A wellbore 32 is drilled into formation 30, and, in at least some applications, is lined with a wellbore casing 34. Perforations 36 are formed through wellbore casing 34 to enable flow of fluids between the surrounding formation 30 and the wellbore 32.

Submersible pumping system 20 is deployed in wellbore 32 by a conveyance system 38 that may have a variety of configurations. For example, conveyance system 38 may comprise tubing 40, such as coiled tubing or production tubing, connected to submersible pump 22 by a connector 42. Power is provided to the at least one submersible motor 24 via a power cable 44. The submersible motor 24, in turn, powers submersible pump 22 which can be used to draw in production fluid through a pump intake 46. In a variety of applications, the submersible pump 22 may comprise a centrifugal pump. Within the submersible centrifugal pump 22, a plurality of impellers is rotated between diffusers to pump or produce the production fluid through, for example, tubing 40 to a desired collection location which may be at a surface 48 of the Earth. As described above, however, the diffusers often suffer deleterious, erosive effects without inclusion of the unique erosion control features described in greater detail below.

It should be noted that many types of electric submersible pumping systems and other types of submersible pumping systems can benefit from the features described herein. Additionally, other components may be added to the pumping system 20, and other deployment systems may be used. Depending on the application, the production fluids may be pumped to the collection location through tubing 40 or through the annulus around deployment system 38. The submersible pump or pumps 22 also may utilize different types of stages, such as mixed flow stages or radial flow stages, having various styles of impellers and diffusers.

Figure 2:
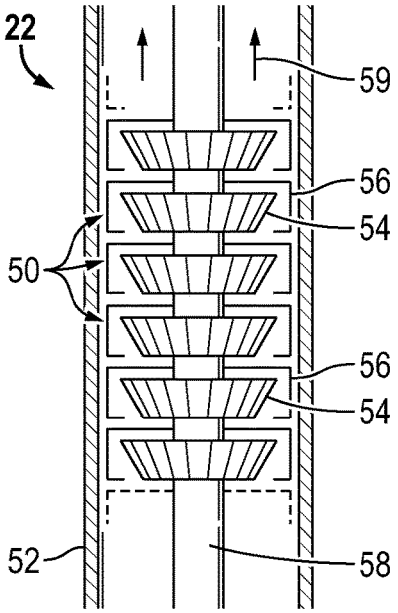
FIG. 2 is an illustration of an example of a centrifugal pump having a plurality of stages with each stage comprising an impeller and a diffuser, according to an embodiment of the disclosure.

Referring generally to FIG. 2, a portion of an embodiment of submersible pump 22 is illustrated. In this embodiment, the submersible pump 22 is a centrifugal pump comprising at least one stage and often a plurality of stages 50 disposed within an outer pump housing 52. Each stage 50 comprises pump components for inducing and directing fluid flow. As illustrated, the pump components in each stage comprise an impeller 54 and a diffuser 56. Impellers 54 are rotated by a shaft 58 coupled with an appropriate power source, such as submersible motor 24, to pump fluid through centrifugal pump 22 in the direction of arrow 59.

Each rotating impeller 54 moves fluid from the upstream diffuser 56 into and through the downstream diffuser 56 and into the next sequential impeller 54 until the fluid is expelled from centrifugal pump 22. By way of example, each rotating impeller 54 may discharge fluid to the adjacent downstream diffuser 56 which routes the fluid into a diffuser bowl for receipt by the next sequential impeller 54. The fluid flow is routed through the sequential stages 50 of the submersible centrifugal pump 22 until the fluid is expelled from the submersible pump 22.

Figure 3:
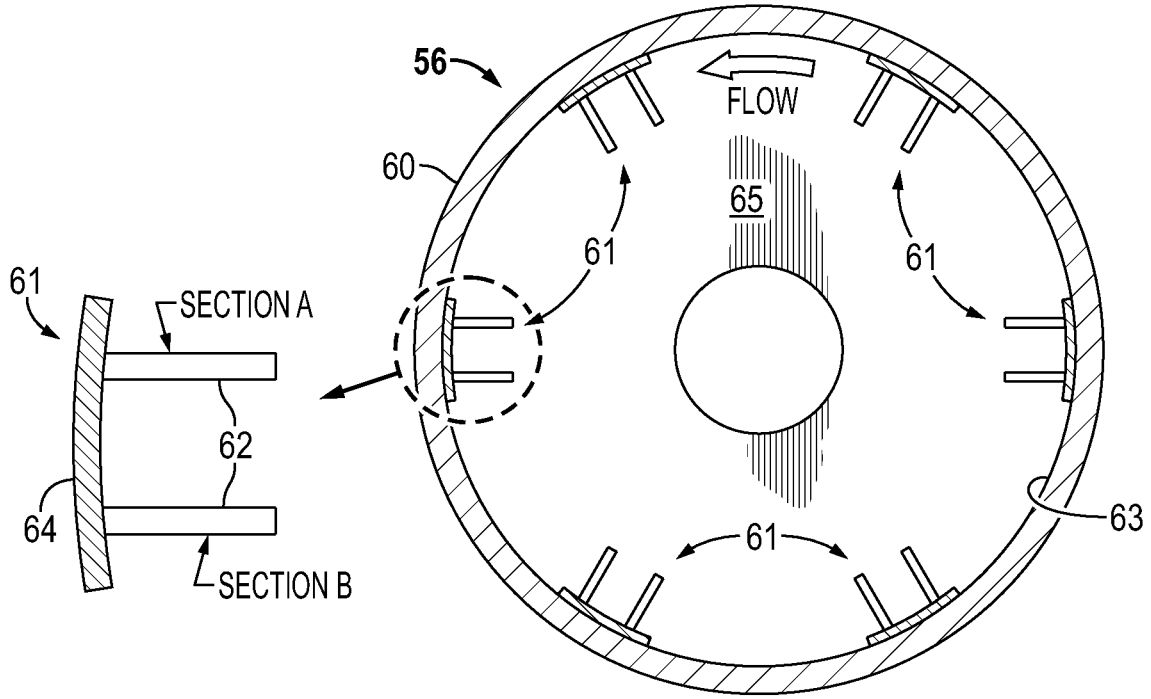
FIG. 3 is an illustration of an example of a rib feature employed to reduce the detrimental impact of sand in the pumped fluid, according to an embodiment of the disclosure.

Referring generally to FIG. 3, an example of diffuser 56 is illustrated as comprising a diffuser bowl 60 having a rib feature 61 which, in this embodiment, comprises a plurality of anti-swirl ribs 62. In this embodiment and some of the other embodiments described herein, the rib feature 61 may be positioned to extend radially inwardly from an outer radius internal wall 63 of diffuser 56. For example, the rib feature 61 may extend radially inwardly from the outer, internal wall 63 forming diffuser bowl 60. In various embodiments described herein, the wall 63 is disposed at the radially outer region of diffuser bowl 60 and may be oriented transversely, e.g. perpendicularly, with respect to a floor 65 of the diffuser bowl 60.

The rib feature 61 may be oriented generally transversely with respect to the flow of fluid moving through the diffuser 56. In some embodiments, the rib feature 61 also is oriented transversely with respect to floor 65 while extending partially into an interior of the diffuser bowl 60. During operation of submersible pump 22, the rib feature 61 reduces the tangential velocity, e.g. swirl, of the fluid in the cavity between the diffuser 56 and the impeller 54, e.g. between the diffuser shroud and the impeller shroud. By reducing the swirl, sand in the flowing fluid has a less detrimental impact on regions otherwise susceptible to erosion. For example, the reduced tangential velocity reduces the potential erosive effects of the sand particles on an outer diameter region of the diffuser where the wall 63 joins the floor 65. In the example illustrated in FIG. 3, pairs of rectangular ribs 62 are attached to and extend from a base protuberance 64 which is attached to the wall 63 of diffuser bowl 60. However, ribs 62 may be located at other wall surfaces along the path of fluid flow.

The size and shape of each rib 62 as well as the spacing between ribs 62 may vary. However, one example employs double ribs 62 which each have a width of approximately 0.1 inch and extend from the common base 64 with a spacing of approximately 0.2 inch between the pair of ribs 62 extending from the common base 64. It should be noted that the width of ribs 62, the spacing between ribs 62, and the number of ribs 62 may vary according to the parameters of a given application. By way of example, the width of the ribs 62 may be in the range from 0.05-0.2 inches and the spacing between two or more ribs may be in the range of 0.1-0.3 inches. Other dimensions also may be utilized in certain applications.

The illustrated double rib structure provides an extra obstruction to the path of sand swirling at the perimeter of the diffuser bowl 60. Some sand may be trapped at, for example, Section A thus leading to a lower sand concentration at the next section, Section B. This can provide a time lag which reduces the effect of sand at the particular section. In this example, base 64 also may be constructed to provide extra thickness at the circumference of the diffuser 56 which is the area prone to the greatest erosion. The base 64 also may be used to establish a desired gap between the two corresponding ribs 62, thus establishing a time lag in the flow from Section A to Section B.

Figure 4:
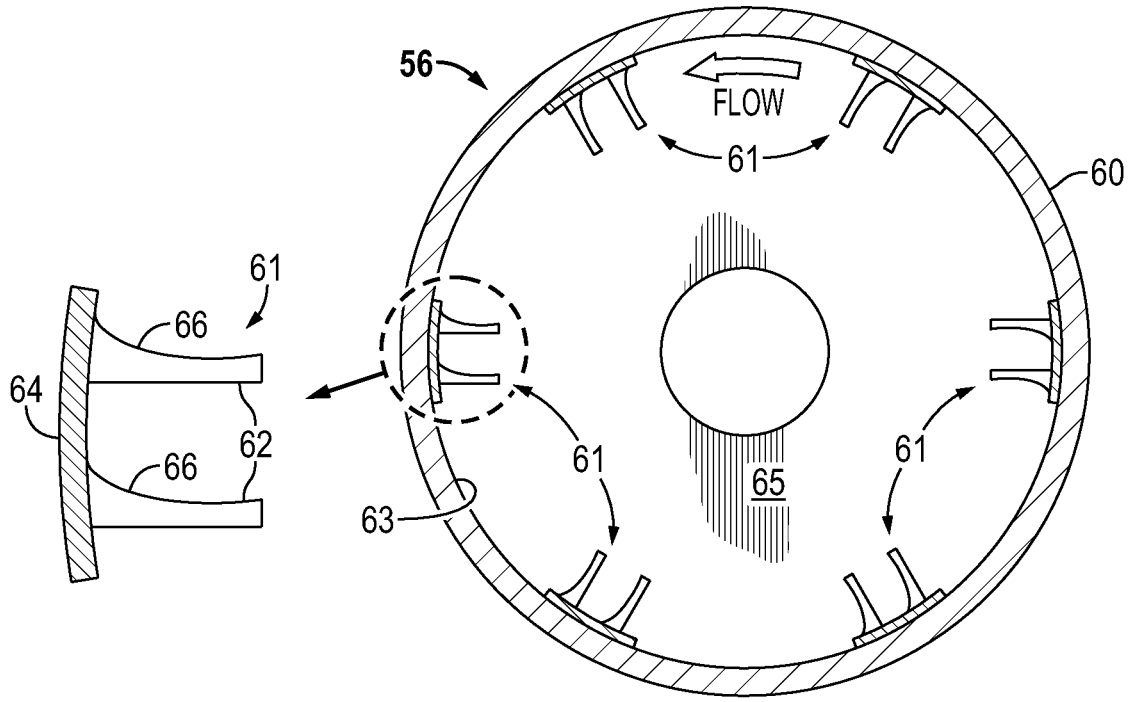
FIG. 4 is an illustration of another example of a rib feature employed to reduce the detrimental impact of sand in the pumped fluid, according to an embodiment of the disclosure.
Figure 5:
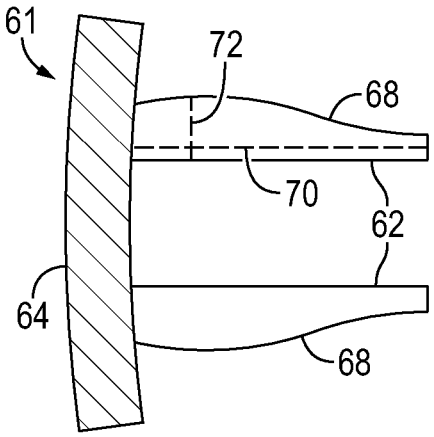
FIG. 5 is an illustration of another example of a rib feature employed to reduce the detrimental impact of sand in the pumped fluid, according to an embodiment of the disclosure.

Referring generally to FIG. 4, another embodiment is illustrated in which rib feature 61 comprises ribs 62 in the form of double streamlined ribs. In this example, pairs of ribs 62 again extend from the common base 64 but each rib has a streamlined shape with a desired curvature 66. In some applications, each rib 62 of the pair of ribs has an aero foil shape or contour 68, as illustrated in FIG. 5. In this embodiment, the aero foil shaped ribs 62 facilitate movement of the sand particles smoothly over the contour of the aero foil along the pressure gradient. The curvature of contour 68 facilitates movement of the sand downstream into the main flow of fluid through the submersible pump 22. The common base 64 functions similarly to that described above with reference to FIG. 3.

Figure 6:
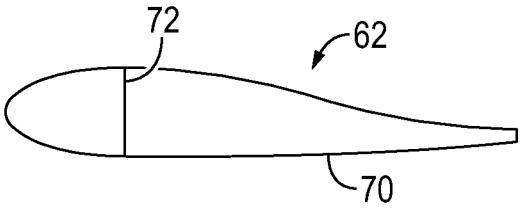
FIG. 6 is an illustration of another example of a rib feature employed to reduce the detrimental impact of sand in the pumped fluid, according to an embodiment of the disclosure.

The contour 68 may be adjusted by adjusting a chord length 70 of the aero foil shape and/or a thickness 72 of each rib 62. The chord length 70 and thickness 72 may vary depending on the type of submersible pump 22 and the parameters of a given application. However, an example comprises ribs 62 having a chord length 70 of approximately 0.4 inch and a thickness 72 determined by a thickness-to-chord ratio of 12% (0.12). In this specific example, a National Advisory Committee for Aeronautics (NACA) 0012 aero profile is assumed and the thickness/chord length ratio approximately equals 0.12, however other aero profiles may be applied. As illustrated in FIG. 6, the diffuser 56 also may utilize a single rib construction in which single aero foil shaped ribs are employed instead of the double rib construction in which two ribs 62 extend from each base 64. It should be noted the chord lengths 70 and thicknesses 72 may vary depending on the specifics of a given application. For example the chord length 70 may be in the range of 0.1-0.7 inches and the thickness may be determined by a thickness-to-chord ratio of 5-20%. However, other dimensions and dimensional relationships may be utilized in certain applications.

Figure 7:
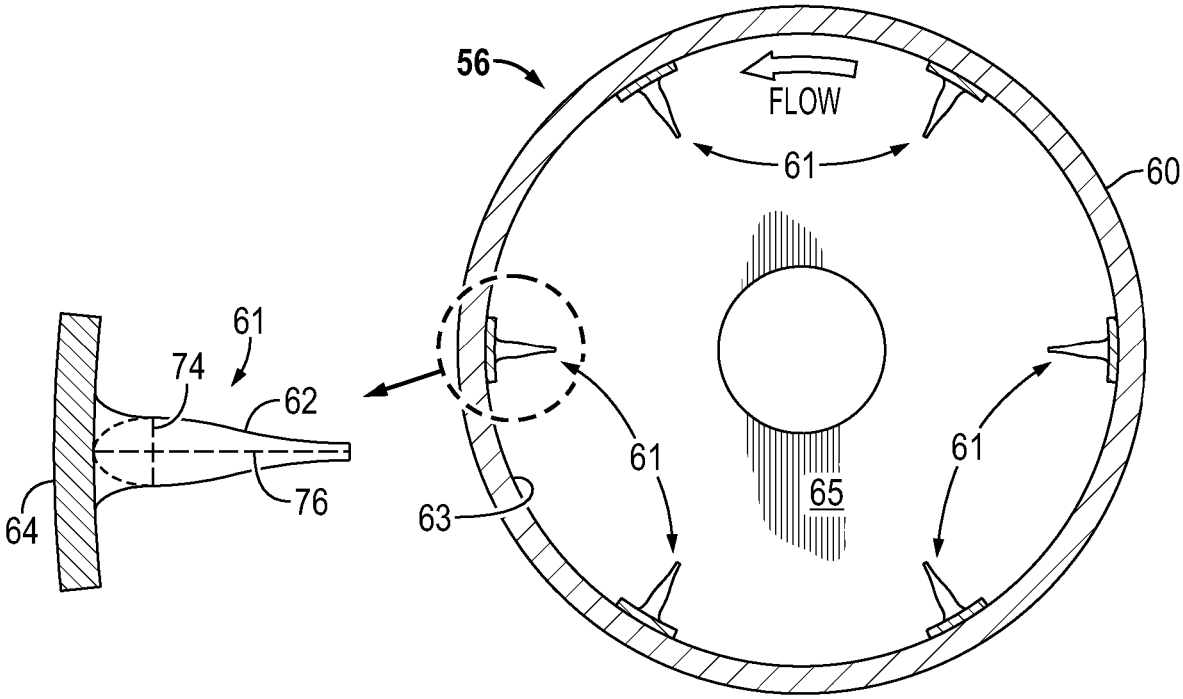
FIG. 7 is an illustration of another example of a rib feature employed to reduce the detrimental impact of sand in the pumped fluid, according to an embodiment of the disclosure.
Figure 8:
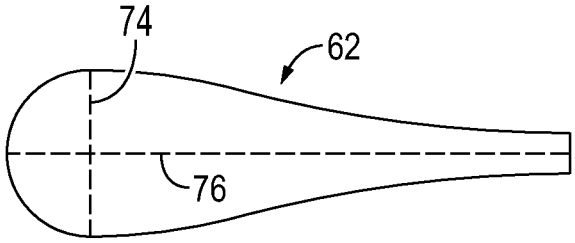
FIG. 8 is an illustration of an example of a rib used in the rib feature illustrated in FIG. 7, according to an embodiment of the disclosure.

Referring generally to FIGS. 7 and 8, another embodiment is illustrated in which the rib feature 61 is in the form of a single rib 62 extending radially inwardly from base 64 and the rib 62 is bulb shaped. As with other embodiments described herein, the base 64 may be mounted along the wall 63 of, for example, diffuser bowl 60. The bulb shape provides a double aero foil without having a gap between the pair of ribs 62. Effectively, the double aero foil construction provides opposed aero foils having a thickness 74 and a chord length 76 as illustrated in FIGS. 7 and 8. The thickness 74 and the chord length 76 may vary between pumps and applications. However, a specific example utilizes a bulb shaped construction having a chord length 76 of approximately 0.4 inch while the thickness 74 is determined using the thickness-to-chord length ratio of 0.24 at the quarter chord location. As with the embodiment illustrated in FIG. 6, the dimensions and dimensional relationships may vary according to similar ranges to accommodate certain applications.

Figure 9:
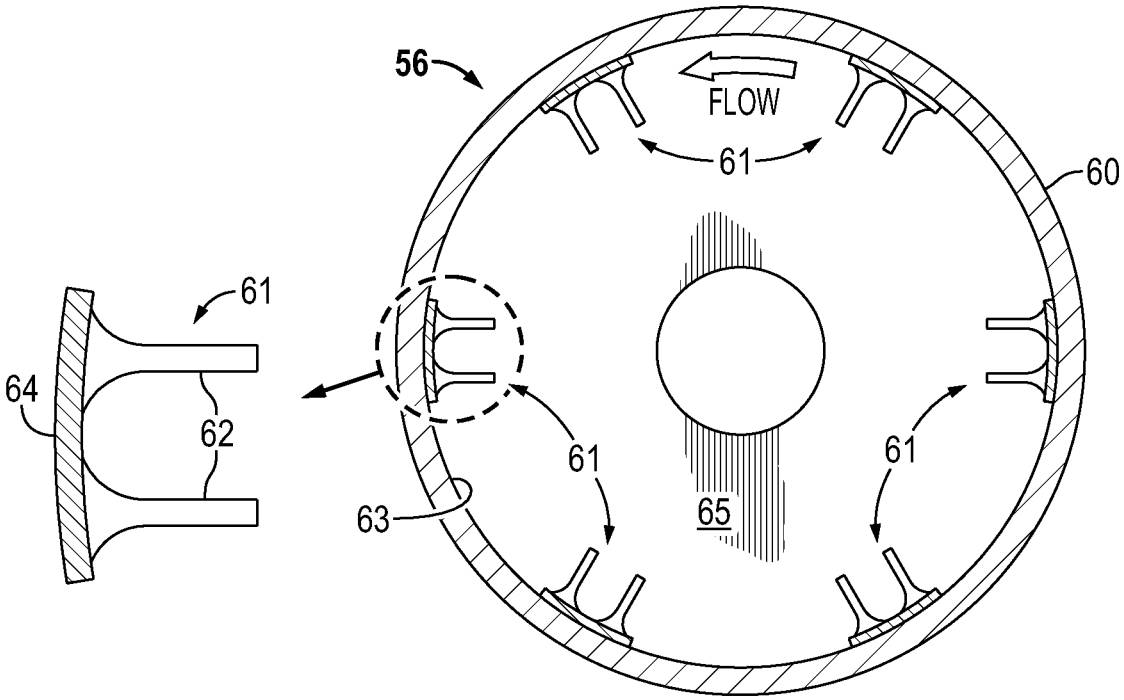
FIG. 9 is an illustration of another example of a rib feature employed to reduce the detrimental impact of sand in the pumped fluid, according to an embodiment of the disclosure.

FIG. 9 illustrates a double bulb type construction which employs double bulb ribs 62 extending from each base 64. The dual streamlines provided by the double bulb type construction ensures a smooth passage which facilitates movement of the sand away from the circumference of the diffuser 56. By moving the sand away from the circumference of the diffuser 56, the erosion effects are reduced.

Figure 10:
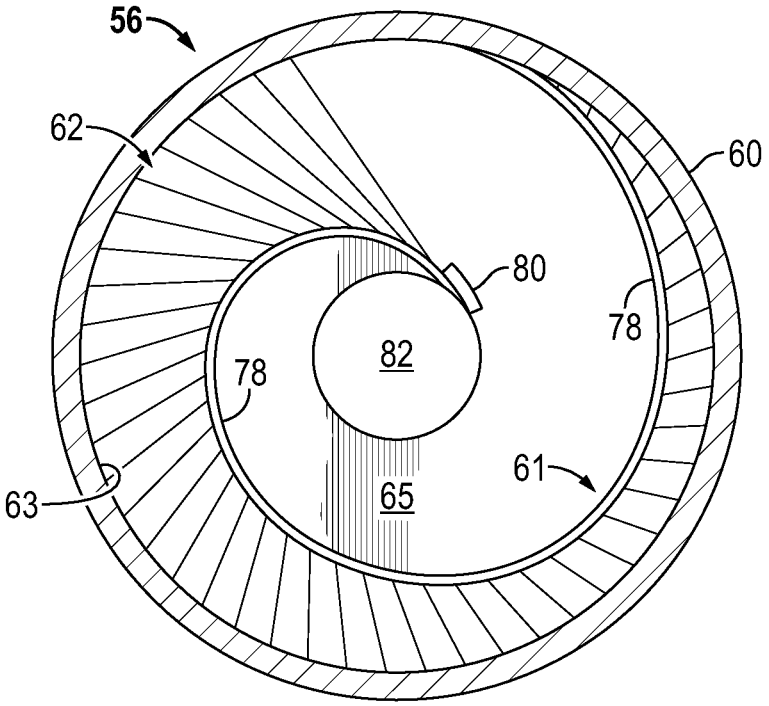
FIG. 10 is an illustration of another example of a rib feature employed to reduce the detrimental impact of sand in the pumped fluid, according to an embodiment of the disclosure.

Referring generally to FIG. 10, another embodiment is illustrated in which the rib feature 61 is in the form of rib 62 constructed as a spiral rib having a spiral 78. The spiral 78 runs in, for example, the clockwise direction from the outer diameter region to the inner diameter region of the diffuser 56, e.g. from an outer to an inner region of diffuser bowl 60. The region between the rib 62 and the circumference may be solid to prevent accumulation of sand. In some embodiments, there also can be a blocker member 80 located at the end of the rib 62 in a position which blocks the sand and allows it to recirculate within an annular space. Consequently, the sand is forced to exit through a center 82. The shape, configuration, and orientation of the spiral rib 62 may be changed to accommodate various applications.

Figure 11:
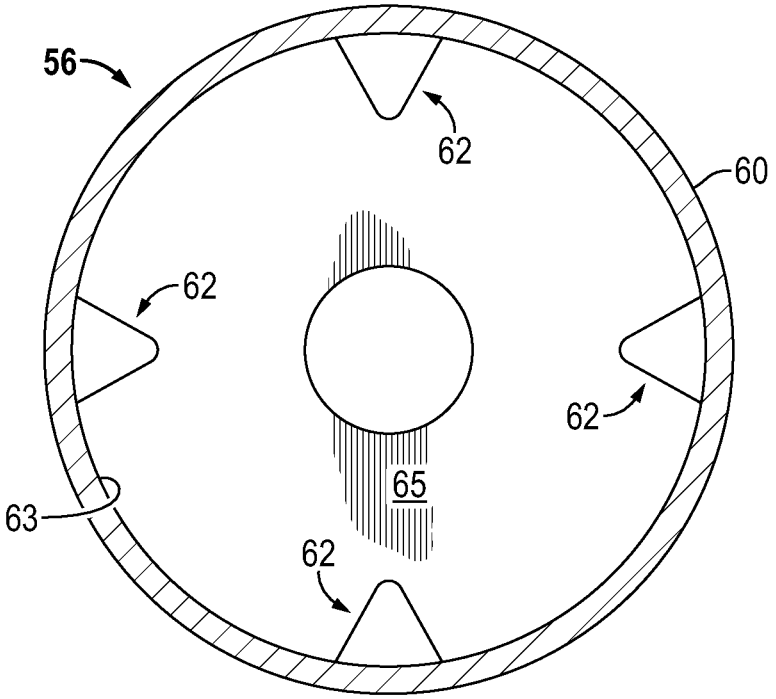
FIG. 11 is an illustration of another example of a rib feature employed to reduce the detrimental impact of sand in the pumped fluid, according to an embodiment of the disclosure.

Referring generally to FIG. 11, another embodiment is illustrated in which the rib feature 61 comprises rib 62 having a triangular shape. Depending on the application, the number and distribution of the triangular ribs 62 may vary. The "triangular" shape also can be constructed in a variety of forms and configurations. For example, the base of the rib 62 at the outer diameter may have a variety of dimensions relative to the tip positioned toward the inner diameter of the diffuser 56.

Figure 12:
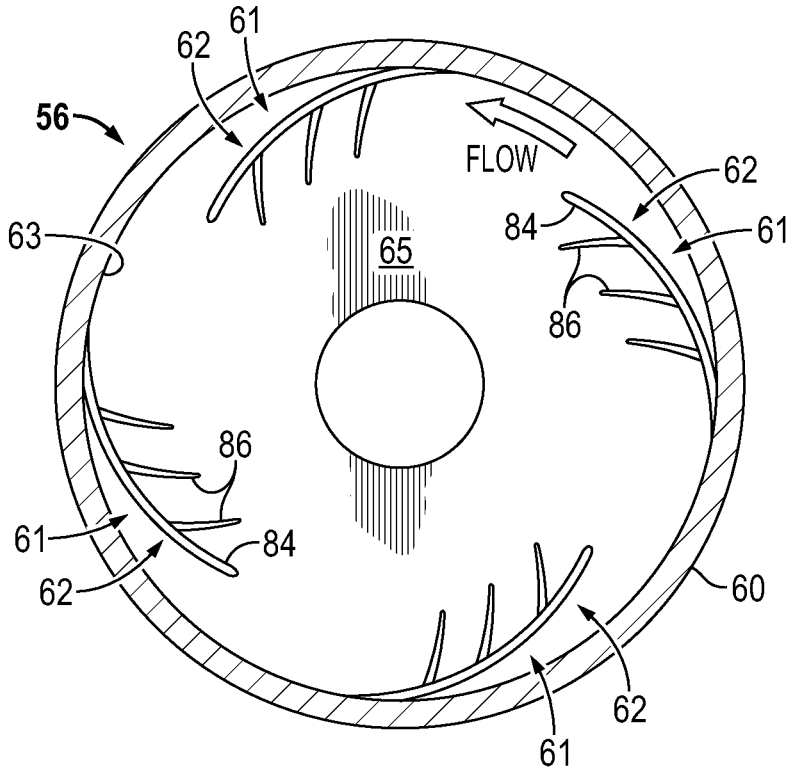
FIG. 12 is an illustration of another example of a rib feature employed to reduce the detrimental impact of sand in the pumped fluid, according to an embodiment of the disclosure.

Referring generally to FIG. 12, another embodiment is illustrated in which rib feature 61 again comprises a plurality of ribs 62. Each rib 62 is in the form of a spiral branched rib having a generally curved section 84 from which a plurality of branches 86 extend. The spiral shape of the curved sections 84 ensures a natural progression of the sand from a circumferential region to a center region of the diffuser 56 and its diffuser bowl 60. The branches 86 further ensure multiple redundancies, thus leaving less sand to move to the next sequential branch 86. The number of spiral branched ribs 62 may vary, but the general shape and orientation directs fluid flow toward the center of the diffuser 56 and facilitates a smooth flow of fluid toward the center.

Figure 13:
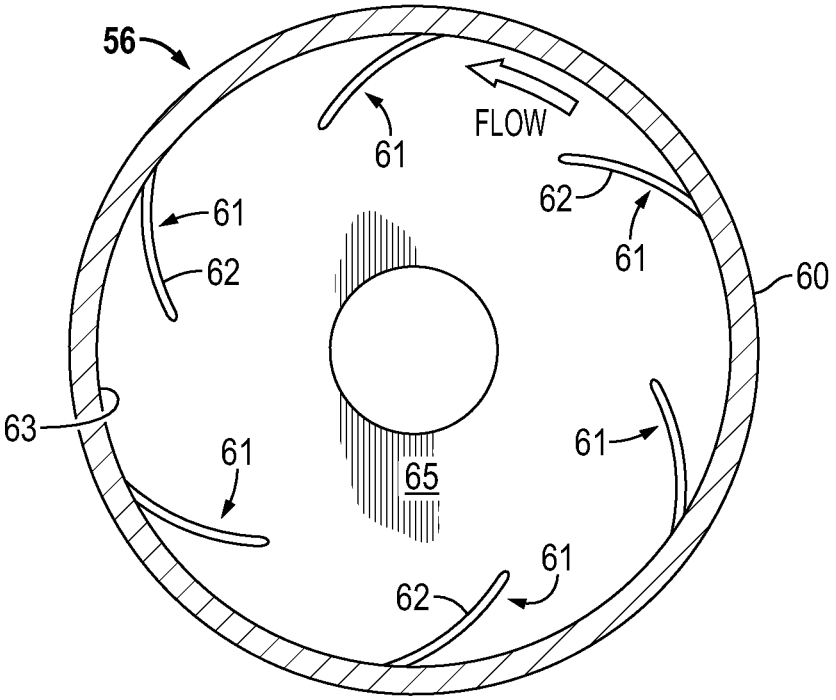
FIG. 13 is an illustration of a rib feature with ribs which may be adapted according to configurations described herein to reduce the detrimental impact of sand in the pumped fluid, according to an embodiment of the disclosure.
Figure 14:
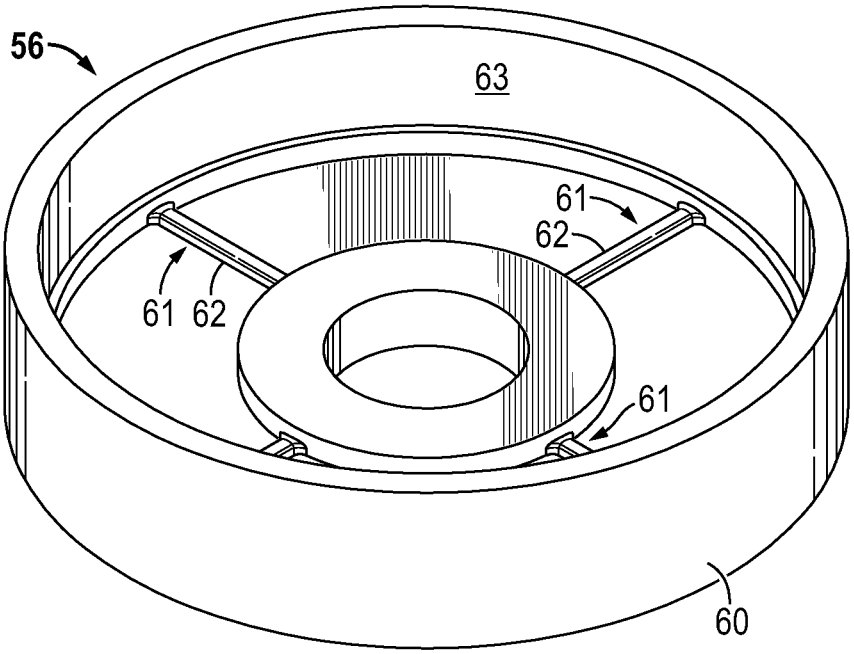
FIG. 14 is an illustration of rectangular ribs which may be adapted according to configurations described herein to reduce the detrimental impact of sand in the pumped fluid, according to an embodiment of the disclosure.

Referring generally to FIG. 13, an embodiment is illustrated in which rib feature 61 comprises ribs 62 constructed in a vane type configuration. The number and distribution of the vane type ribs 62 may vary, but the ribs are oriented to again drive sand towards the center of the diffuser 56 to prevent accumulation of sand at the circumference of the diffuser 56. The vane type ribs 62 may be combined with various shapes and configurations of rib embodiments described herein. Similarly, FIG. 14 illustrates generally rectangular, anti-swirl type ribs 62, but these types of ribs also may be combined with various shapes and configurations of rib embodiments described herein.

Figure 15:
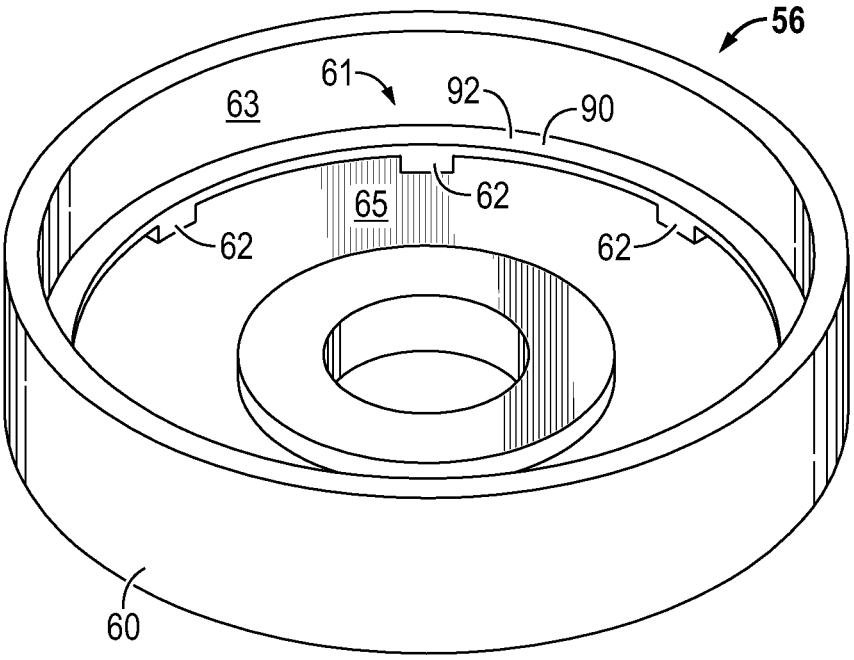
FIG. 15 is an illustration of an example of a diffuser with shielded anti-swirl ribs, according to an embodiment of the disclosure.

Referring generally to FIG. 15, another embodiment is illustrated which reduces tangential velocity of the fluid (and thus of the sand) in regions of the diffuser 56 susceptible to erosion. This embodiment also is constructed to minimize friction on the impeller that would otherwise be caused by the relative difference in velocity between the cavity fluid slowed by the ribs and the corresponding portion of rotating impeller 54, e.g. the rotating impeller shroud. In this example, the rib feature 61 comprises anti-swirl ribs 62 which are in the form of shielded anti-swirl ribs. As illustrated in FIG. 15, the ribs 62 are disposed at spaced intervals along the outer, internal wall 63 adjacent floor 65. However, the ribs 62 are shielded by a shield 90. By way of example, shield 90 may be in the form of a lip 92 which extends circumferentially along the wall 63 on top of the ribs 62. Consequently, the lip 92 is spaced from the floor 65 of diffuser 56 to create shielded or covered gaps between ribs 62.

Figure 16:
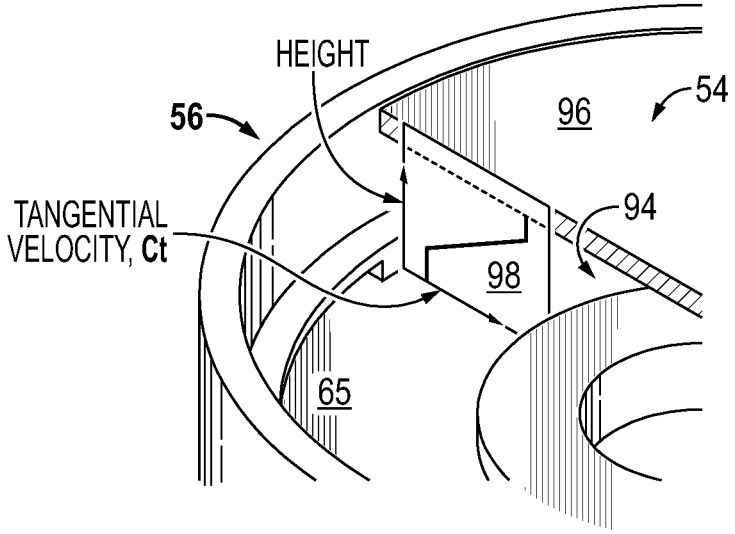
FIG. 16 is an illustration similar to that of FIG. 15 with the addition of a corresponding impeller shroud and a diagram illustrating a reduction in tangential velocity, e.g. swirl, via the shielded anti-swirl ribs located in a region susceptible to erosion while allowing substantially higher tangential velocity proximate the corresponding impeller shroud to minimize friction or drag effects on the impeller, according to an embodiment of the disclosure.

In this embodiment, the anti-swirl ribs 62 reduce the tangential velocity, e.g. swirl, of the fluid in the corresponding cavity 94 between the diffuser 56 and the impeller 54, as illustrated in FIG. 16. Without anti-swirl ribs 62, substantial swirl would be imparted to the cavity fluid by leakage and movement of high swirl fluid from an exit of one impeller 54 toward an inlet of a sequential impeller through, for example, a front seal. Effectively, the change from high-pressure at an impeller tip to low pressure at the inlet of the subsequent impeller causes the swirl which, in turn, imparts high velocity to sand particles in the fluid. The high velocity sand particles tend to cause severe erosive wear. In the example illustrated, however, the anti-swirl ribs 62 reduce the tangential velocity between a portion, e.g. shroud, 96 of the adjacent impeller 54 and the shroud of the diffuser 56 formed by floor 65 and outer, internal wall 63. Thus, the potential for erosion in the region where floor 65 joins wall 63 is substantially reduced.

Additionally, the lip 92 effectively shields the anti-swirl ribs 62 in a manner which minimizes disk friction. Otherwise, the reduction in tangential velocity of fluid in cavity 94 could act against impeller shroud 96 and create substantial disk friction, e.g. drag. In FIG. 16, a graph 98 is superimposed in the cavity 94 between diffuser floor 65 of diffuser 56 and shroud 96 of impeller 54. As illustrated by graph 98, the tangential velocity of fluid in cavity 94 is substantially reduced by anti-swirl ribs 62 between lip 92 and diffuser floor 65. However, the effects of this reduced tangential velocity are shielded from the remainder of cavity 94 as illustrated graphically by the substantial increase in tangential velocity moving from lip 92 toward shroud 96 of impeller 54. Graph 98 shows that tangential velocity is low from diffuser floor 65 over the axial extent of ribs 62 (due to the braking action of ribs 62) and then the tangential velocity rapidly increases over the axial extent near and above shield lip 92 moving toward shroud 96.

Figure 17:
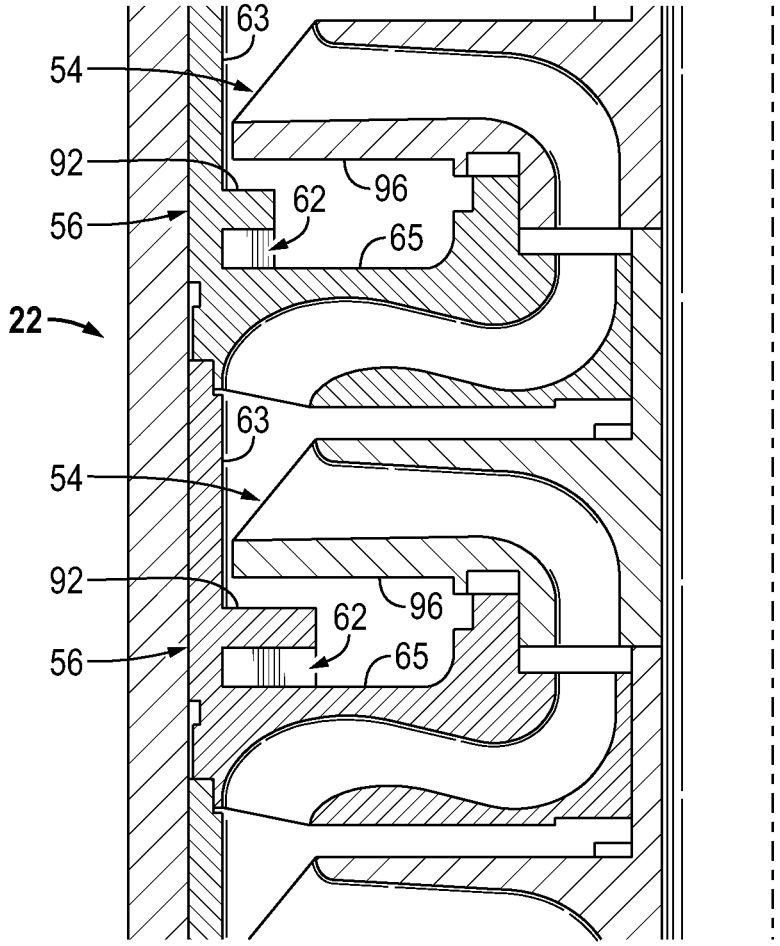
FIG. 17 is a schematic cross-sectional illustration of a portion of a centrifugal pump showing stages having corresponding impellers and diffusers with embodiments of shielded anti-swirl ribs, according to an embodiment of the disclosure.

In FIG. 17, a schematic, partial cross-sectional view of centrifugal pump 22 is illustrated as having a plurality of impellers 54 and diffusers 56 arranged in sequential stages. Depending on the application, the radial extent of the lip 92 and the spaced anti-swirl ribs 62 may vary. In FIG. 17, different stages of submersible pump 22 are illustrated as having shielded lips 92 with different radial extents, however many embodiments tend to use lips 92 and anti-swirl ribs 62 with common radial extents throughout the stages. Similarly, the circumferential gaps between ribs 62 may be selected according to the parameters of a given application. Regardless, the shielding of spaced ribs 62 via lip 92 enables a reduction in the tangential velocity of the cavity fluid to reduce erosive effects while also minimizing disk friction by allowing relatively increased tangential velocity proximate the impeller 54, e.g. proximate the impeller shroud 96.

It should be noted that the various embodiments of rib feature 61 and ribs 62 described herein may be positioned at other locations rather than the outer diameter. For example, the ribs 62 may be positioned at various locations between the outer and inner diameters. The rib feature 61/ribs 62 may be located in the diffuser bowl 60 or at other locations susceptible to erosion due to sand in the flowing fluid. Additionally, the dimensions and configurations of the ribs 62 may be varied depending on the parameters of a given application and/or pump. Various configurations of the rib feature 61/ribs 62 may be used in combination with shield 90, e.g. lip 92.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling erosion in a pumping assembly, comprising:

a pump having an impeller and a diffuser, the diffuser comprising a diffuser bowl and an outer wall, a first surface of the diffuser bowl defining a floor of the diffuser, and a second, opposite surface of the diffuser bowl partially defining a flow path through the diffuser, wherein in use fluid flows through the flow path through the diffuser and then through the impeller, a cavity defined by the floor of the diffuser, a shroud of the impeller, and the outer wall of the diffuser, the diffuser comprising a plurality of ribs positioned in the diffuser bowl of the diffuser, the plurality of ribs being oriented to reduce the tangential velocity of fluid in the cavity and thus to reduce erosive effects on regions of the diffuser during rotation of the impeller, and the diffuser further comprising a lip extending radially inwardly into the cavity from the outer wall of the diffuser on top of the plurality of ribs.

2. The system as recited in claim 1, wherein the lip shields the plurality of ribs to enable reduction of the tangential velocity along the axial extent of the diffuser proximate the plurality of ribs while allowing a substantially increased tangential velocity along the axial extent between the plurality of ribs and the impeller.

3. The system as recited in claim 1, wherein the plurality of ribs comprises ribs arranged in pairs which extend from a base.

4. The system as recited in claim 1, wherein the plurality of ribs comprises ribs having a thickness-to-chord ratio in a range between approximately 0.05 and 0.24.

5. The system as recited in claim 1, wherein the plurality of ribs comprises ribs which have an aero foil shape.

6. The system as recited in claim 1, wherein the plurality of ribs comprises ribs which have a double aero foil shape.

7. The system as recited in claim 1, wherein the plurality of ribs comprises ribs which have a bulb shape.

8. The system as recited in claim 1, wherein the plurality of ribs comprises ribs which have a spiral shape.

9. The system as recited in claim 1, wherein the plurality of ribs comprises ribs which have a triangular shape.

10. The system as recited in claim 1, wherein the plurality of ribs comprises ribs in the form of spiral branched ribs.

11. A system, comprising:

an electric submersible pumping system having a submersible centrifugal pump, a motor to power the submersible centrifugal pump, and a motor protector, the submersible centrifugal pump comprising:

a plurality of stages disposed within an outer pump housing, each stage having an impeller arranged to direct a flow of fluid into a flow path of an adjacent diffuser which, in turn, is arranged to direct the flow of fluid to a flow path of the next sequential impeller until the flow of fluid is discharged from the submersible centrifugal pump, at least one diffuser comprising:

a rib feature oriented to extend generally transversely from an interior surface of an outer wall of the diffuser, the rib feature being arranged to reduce tangential velocity of fluid proximate the rib feature; and a lip spaced from a floor of the diffuser and positioned to shield the rib feature so as to enable increased tangential velocity of fluid between the lip and the next sequential impeller, the floor of the diffuser positioned axially between the flow path of the diffuser and the rib feature, and the lip positioned axially between the rib feature and the next sequential impeller.

12. The system as recited in claim 11, wherein the rib feature is positioned to extend radially inwardly from an outer diameter wall in a diffuser bowl of each diffuser.

13. The system as recited in claim 12, wherein the rib feature comprises a plurality of ribs arranged in pairs which extend from a base.

14. The system as recited in claim 12, wherein the rib feature comprises ribs which have an aero foil shape.

15. The system as recited in claim 12, wherein the rib feature comprises ribs which have a spiral shape.

16. The system as recited in claim 12, wherein the rib feature comprises ribs which have a triangular shape.

17. The system as recited in claim 12, wherein the lip extends around the entire interior circumference of the diffuser.

18. A method, comprising:

providing a pump with a shaft driven impeller rotatably positioned in cooperation with a diffuser;

positioning a rib feature in the diffuser such that the rib feature extends adjacent a diffuser floor and radially inwardly from an outer wall surface within the diffuser to reduce erosion of the diffuser during operation of the pump; and using a shield in combination with the rib feature to minimize friction losses otherwise induced by the rib feature by forming a radially inwardly extending lip along an interior of a diffuser bowl of the diffuser, the lip extending radially inwardly along a downstream edge of the rib feature;

wherein in use, the rib feature is configured to reduce a tangential velocity of fluid axially between the diffuser floor and the lip over an axial extent of the rib feature, and the lip is configured to shield fluid axially between the lip and the impeller from effects of the rib feature such that a tangential velocity of the fluid axially between the lip and the impeller increases compared to the tangential velocity of the fluid axially between the diffuser floor and the lip.

19. The method as recited in claim 18, further comprising operating the pump to create a fluid flow through the diffuser along the rib feature to enable the rib feature to reduce the tangential velocity of the fluid on one side of the shield.

* * * * *